US011603971B2

(12) United States Patent
Peard et al.

(10) Patent No.: US 11,603,971 B2
(45) Date of Patent: Mar. 14, 2023

(54) LIGHT DEVICE FOR CREATING A LIGHT BEAM AND EFFECTS WHEEL SUITABLE FOR SAID LIGHT DEVICE

(71) Applicant: AYRTON, Villebon-sur-Yvette (FR)

(72) Inventors: Yvan Peard, Antony (FR); Cyril Union, Fromont (FR)

(73) Assignee: AYRTON, Villebon-sur-Yvette (FR)

( * ) Notice: Subject to any disclaimer, the term of this patent is extended or adjusted under 35 U.S.C. 154(b) by 9 days.

(21) Appl. No.: 17/599,159

(22) PCT Filed: Mar. 30, 2020

(86) PCT No.: PCT/EP2020/058920

§ 371 (c)(1),
(2) Date: Sep. 28, 2021

(87) PCT Pub. No.: WO2020/201196

PCT Pub. Date: Oct. 8, 2020

(65) Prior Publication Data

US 2022/0034460 A1 Feb. 3, 2022

(30) Foreign Application Priority Data

Mar. 29, 2019 (FR) ..... 1903412

(51) Int. Cl.
*F21S 10/00* (2006.01)
*F21V 3/10* (2018.01)
(Continued)

(52) U.S. Cl.
CPC ..... *F21S 10/007* (2013.01); *F21V 3/10* (2018.02); *F21V 14/006* (2013.01); *F21W 2131/406* (2013.01)

(58) Field of Classification Search
CPC ..... F21S 10/007; F21V 14/006
See application file for complete search history.

(56) References Cited

U.S. PATENT DOCUMENTS 4,894,760 A * 1/1990 Callahan ..... F21S 10/02 362/277
5,416,681 A * 5/1995 Wu ..... F21V 9/08 362/277

(Continued)

FOREIGN PATENT DOCUMENTS

CN 202532389 U 11/2012
WO WO 2011/029449 A1 3/2011

(Continued)

OTHER PUBLICATIONS

International Search Report for International Application No. PCT/EP2020/058920 (dated May 14, 2020).

*Primary Examiner* — Alexander K Garlen
(74) *Attorney, Agent, or Firm* — Jenkins, Wilson, Taylor & Hunt P.A.

(57) ABSTRACT

The present invention relates to a lighting device for creating a light beam comprising a light source and an optical element positioned along an optical axis (80) between said light source and an outlet for said light beam wherein said optical element comprises an at least partially transparent or translucent effects wheel (1), said effects wheel (1) being movable between a first active position in which the effects wheel (1) is positioned along said optical axis (80) and a second inactive position, in which the effects wheel (1) is positioned outside said optical axis (80), and actuation means suitable for moving the effects wheel (1) in a back-and-forth movement between its first active position and its second inactive position.

6 Claims, 3 Drawing Sheets

(51) Int. Cl.
*F21V 14/00* (2018.01)
*F21W 131/406* (2006.01)

(56) References Cited

U.S. PATENT DOCUMENTS

| | | | | |
|---|---|---|---|---|
| 5,791,755 | A * | 8/1998 | Henry | G02B 7/006 362/277 |
| 9,664,361 | B2 * | 5/2017 | Hansen | F21S 10/007 |
| 2003/0076681 | A1 * | 4/2003 | Rasmussen | F21S 10/007 362/322 |
| 2011/0249442 | A1 * | 10/2011 | Jurik | F21S 10/007 362/277 |
| 2012/0230039 | A1 * | 9/2012 | Hansen Ellevang | F21V 14/08 362/427 |
| 2013/0094219 | A1 * | 4/2013 | Jurik | F21V 14/00 362/322 |
| 2015/0092422 | A1 * | 4/2015 | Jurik | F21V 9/04 362/296.09 |
| 2016/0084457 | A1 * | 3/2016 | Jurik | F21V 11/08 362/324 |

FOREIGN PATENT DOCUMENTS

| | | | |
|---|---|---|---|
| WO | WO 2011/119450 | A1 | 9/2011 |
| WO | WO 2012/138770 | A2 | 10/2012 |

* cited by examiner

LIGHT DEVICE FOR CREATING A LIGHT BEAM AND EFFECTS WHEEL SUITABLE FOR SAID LIGHT DEVICE

FIELD OF THE INVENTION

The present invention relates to a lighting device for creating a light beam comprising a light source and an optical element which are positioned along an optical axis between said light source and an outlet for said light beam.

STATE OF THE ART

Lighting devices suitable for creating a light beam, comprising a light source and one or more optical element(s) positioned along an optical axis between said source and an outlet for said light beam, are already known from the state of the art.

An effects wheel is a prime example of an optical element positioned along the optical axis between a light source and an outlet for a light beam. An effects wheel of this type comprises a plurality of at least partially transparent or translucent elements which, depending on the choice of the user of the lighting device, may or may not be positioned along the optical axis between said source and an outlet for said light beam obtained by the lighting device.

As a general rule, the at least partially transparent or translucent elements present inside an effects wheel are provided with a coating which has certain designs, patterns or drawings which make it possible to obtain a light beam capable of projecting said designs, patterns or drawings onto a surface. Said designs, patterns or drawings, combined with a colour, can intensify the effect obtained with said effects wheel.

In practice, the effects wheels known from the state of the art offer limited specific effects. Indeed, as soon as the effects wheel is positioned along the optical axis between said source and an outlet for said light beam, the specific effect obtained can no longer be modified without another element, which is partially transparent or translucent, of said effects wheel being installed.

In the field of entertainment, and more particularly during theatre performances and musical entertainments, the use of lighting devices represents an important part of the setting which thus makes it possible to generate specific lighting effects. The lighting devices are used to complete the visual image offered to the audience. For this reason, in the above-mentioned sectors, there is a constant need to improve the systems that are already in existence and to offer the user more freedom in the choice of lighting devices which allows him/her to create innovative visual effects.

With regard to the above observations, the aim of the present invention consists in proposing a lighting device comprising a light source and an optical element positioned along the optical axis between said light source and an outlet for a light beam to be obtained, wherein said optical element can create innovative visual effects.

Subject of the Invention

The subject of the present invention relates to a lighting device for creating a light beam comprising a light source and an optical element, which are positioned along an optical axis between said light source and an outlet for said light beam, wherein said optical element comprises an at least partially transparent or translucent effects wheel, said effects wheel being movable between a first active position in which the effects wheel is positioned along said optical axis and a second inactive position in which the effects wheel is positioned outside said optical axis, and actuation means suitable for moving the effects wheel in a back-and-forth movement between its first active position and its second inactive position, characterised in that said actuation means are suitable for causing the effects wheel to turn about an axis of rotation of said effects wheel and for moving the effects wheel in a back-and-forth movement between its first active position and its second inactive position in a first direction and a second direction which is substantially perpendicular to this first direction relative to the optical axis of the lighting device to make it possible to position various parts of the surface of the effects wheel along the optical axis of the lighting device.

According to one embodiment of the invention, the actuation means comprise a sliding element fixed on the base of said lighting device and are suitable for performing a back-and-forth movement relative to the optical axis of the lighting device and a pivoting element fixed to said sliding element with the aid of a pivot axis and suitable for pivoting about said pivot axis relative to said sliding element, wherein the effects wheel is fixed to the pivoting element.

According to one embodiment of the invention, the actuation means comprise a holding element suitable for holding the circumference of the effects wheel and for allowing the effects wheel to rotate relative to said holding element and driving means suitable for gripping the circumference of the effects wheel and for causing the effects wheel to turn relative to the holding element.

According to one embodiment of the invention, the circumference of the effects wheel is provided with teeth and the driving means comprise at least one toothed wheel suitable for transmitting a rotation to said effects wheel.

According to one embodiment of the invention, the surface of the effects wheel is covered with a coating substantially in the form of spokes which emanate from the centre of the effects wheel.

According to one embodiment of the invention, the surface of the effects wheel is covered with a coating substantially in the form of concentric circles around the centre of the effects wheel.

According to one embodiment of the invention, the device comprises a base, a projector connected to the base with the aid of a yoke to allow said projector to pivot relative to the base, wherein said light source and said optical element are positioned in said projector.

According to one alternative embodiment of the invention, the invention relates to an effects wheel suitable for a lighting device according to the invention.

BRIEF DESCRIPTION OF THE DRAWINGS

The aims, subject and characteristics of the present invention will become more clearly apparent on reading the following present description with reference to the figures, in which:

FIG. 1 shows a perspective view of an effects wheel 1 and actuation means for enabling the rotation of said effects wheel 1 and moving it in a back-and-forth movement between a first active position, along the optical axis of a lighting device, and a second inactive position in which the effects wheel 1 is situated outside said optical axis of said lighting device. The actuation means comprise a sliding element 30 on which a pivoting element 20 is fixed. The effects wheel 1, which is part of said pivoting element 20, is held by a holding element 2. The holding element 2 is in the shape of a fine metal sheet which holds the toothed wheel 5 and the effects wheel 1. The edges 11 and 12 of said holding element 2 are bent in order to stiffen said holding element 2. Said holding element 2 allows the effects wheel 1 to rotate about a central axis of rotation 10. The holding element 2 is fixed on an element 3 which forms a base element of a pivoting element 20 of the actuation means. The pivoting element 20 can start rotating about a pivot axis 25. The pivoting element 20, which is fixed on a sliding element 30, is suitable for pivoting relative to said sliding element 30 of the actuation means.

Figure 1:
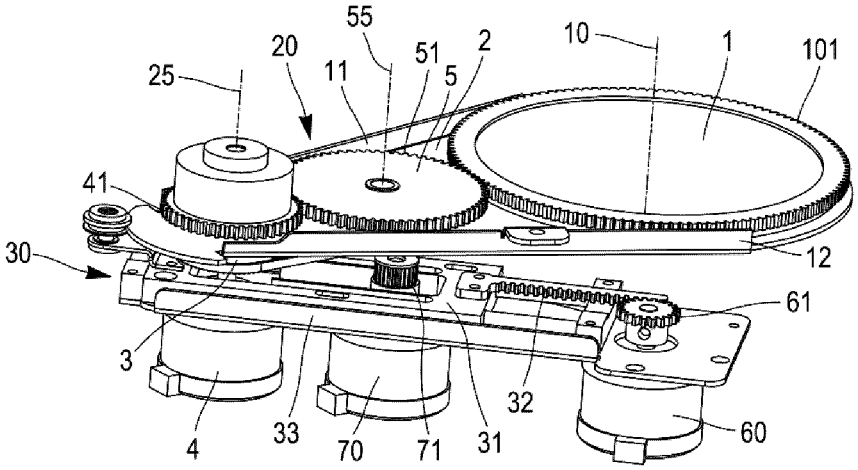
FIG. 1 shows a perspective view of an effects wheel and actuation means of said effects wheel, which are suitable for a lighting device according to the invention.

The motor 4 of the pivoting element 20 is suitable for starting to rotate about the pivot axis 25. The exterior of the motor 4 is provided with teeth 41. Said teeth 41 are suitable for cooperating with the teeth 51 of the toothed wheel 5 that is positioned as an intermediary between the motor 4 and the effects wheel 1. The circumference of said effects wheel 1 is provided with teeth 101 which are suitable for cooperating with the teeth 51 of the intermediate toothed wheel 5. The intermediate toothed wheel 5, which is fixed on a base connected to the element 3, can pivot about an axis of rotation. It should be noted that the actuation of the effects wheel 1 is not limited to the use of toothed wheels. Actuation performed with the aid of a belt may be an alternative solution.

As explained in greater detail with reference to FIGS. 2, 3, 4 and 5, the rotation of the pivoting element 20 about the axis of rotation 25 makes it possible to place the effects wheel 1 either inside or outside the optical axis of a lighting device. The pivoting element 20 and the sliding element 30 are used to move the effects wheel 1.

The sliding element 30 comprises a base 31 fixed inside a guide 32 relative to which said base 31 can move, in a back-and-forth movement, in a longitudinal direction. A motor 60 is connected to the end of the guide 33. The base 31 is connected to the motor 60 with the aid of a "rack and pinion" system, said pinion 61 being present on the axis of rotation of the motor 60 and the rack 32 being fixed on the base 31. The rotation of the motor 60 makes it possible to determine the position of the base 31. With the movement of the base 31, the position of the axis of rotation 25 of the pivoting element 20 is determined. The movement of the base 31 and of the sliding element 30, in combination with the rotation of the pivoting element 20, determines the position of the effects wheel 1 and, more precisely, the position of the axis of rotation 10 of the effects wheel 1 relative to the optical axis of the lighting device.

The pivoting element 20 comprises a motor 4 suitable for rotating the effects wheel 1. A motor 70 is used for the relative rotation of the pivoting element 20 relative to the sliding element 30. The axis of rotation 71 of said motor 70 is connected to the element 3 and can cause the pivoting element 20 to rotate about the axis of rotation 25 so that the effects wheel 1 is in a determined position. Each of the motors 4 and 70 is fixed on the base 31 and moves together with said base 31.

Figure 2:
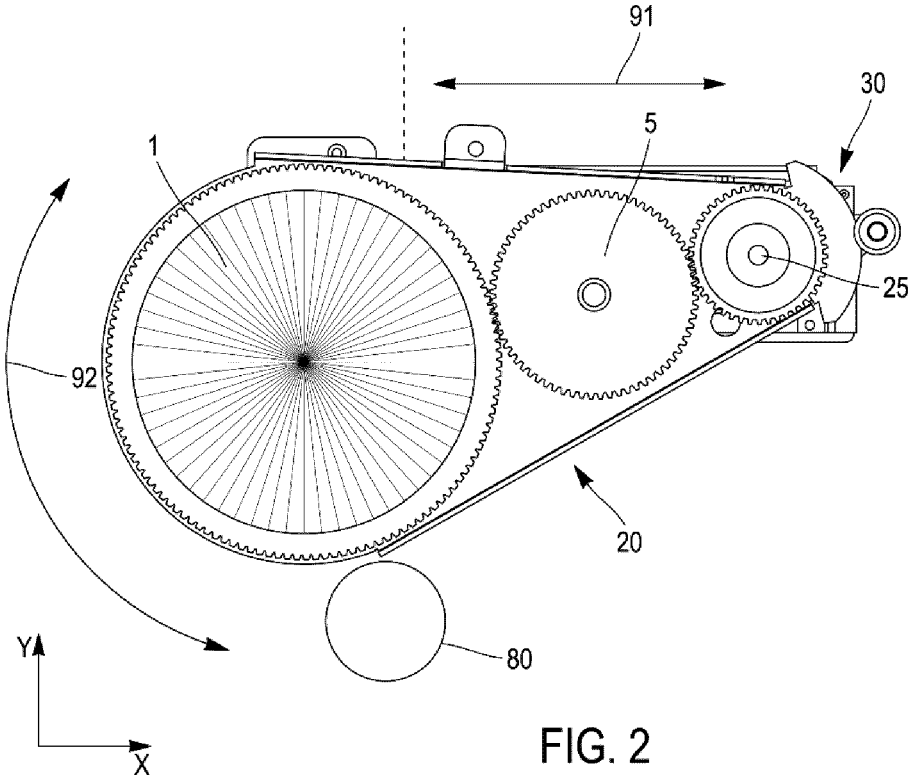
FIG. 2 depicts a top view of an effects wheel according to FIG. 1, said effects wheel being positioned outside the optical axis of a lighting device.

FIG. 2 depicts a top view of the effects wheel 1 and of its actuation means. The optical axis of a lighting device is depicted diagrammatically with the aid of reference 80. In order to refer to various movement possibilities of the effects wheel 1 relative to the optical axis 80 of a lighting device, FIG. 2 illustrates a first direction "x" which represents a first direction of movement relative to the optical axis 80 and a second direction "y", substantially perpendicular to the first direction "x", which represents a second direction of movement relative to the optical axis 80. The arrow 91 illustrates, diagrammatically, the movement of the sliding element 30. The arrow 92, for its part, illustrates a rotation of the pivoting element 20 about the axis of rotation 25.

FIG. 2 depicts the effects wheel 1 situated outside the optical axis 80, this effects wheel 1 having no effect on the light beam produced by the lighting device in which it is installed. Being situated outside the optical axis 80, the effects wheel 1 can be moved by shifting the sliding element 30 in the direction indicated by the arrow 91, and by rotating the pivoting element 20 in the direction indicated by the arrow 92. These two movements make it possible to move the effects wheel 1, for example, so that its centre of rotation 10 is located at the centre of the optical axis 80, as illustrated in FIG. 3.

Figure 3:
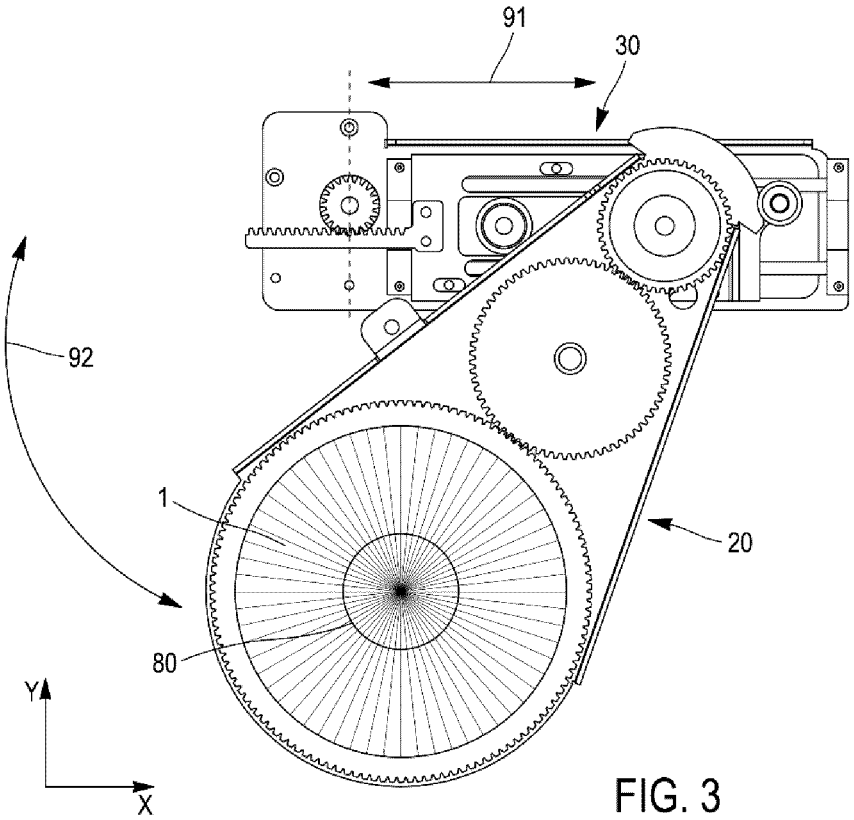
FIG. 3 illustrates an effects wheel according to FIG. 1, the centre of said effects wheel being situated inside the optical axis of a lighting device.

FIG. 3 illustrates the effects wheel 1 in a position in which its axis of rotation 10 is situated at the centre of the optical axis 80. The rotation of the effects wheel 1 inside the optical axis 80 gives a specific effect to the light beam obtained with the lighting device. According to the examples illustrated in FIGS. 2, 3, 4 and 5, the effects wheel 1 is covered with a decoration in the form of lines, which are comparable to spokes, extending from its centre to its circumference. In the position illustrated in FIG. 3, the lines comparable to spokes present on the effects wheel 1, which are combined with the rotation of said effects wheel 1 inside the optical axis 80, give the light beam a particular effect which could be compared to a "sunbeam". Without modifying the drawings present on the effects wheel 1, and by simply moving said effects wheel 1 relative to the optical axis 80, the visual effect obtained can be totally different.

Figure 4:
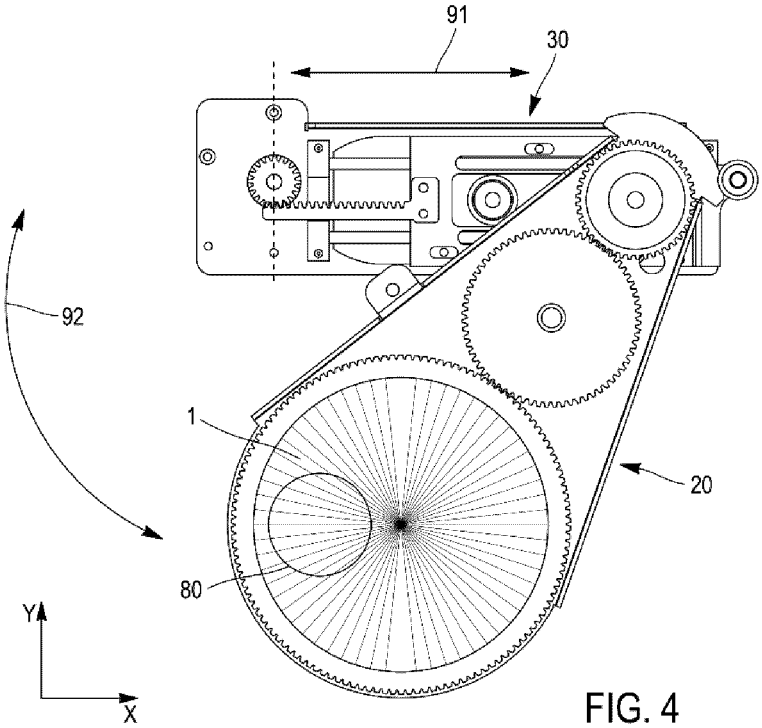
FIG. 4 shows the device according to FIG. 3, wherein the effects wheel is moved from a first position "x" relative to the position as shown in FIG. 3.

FIG. 4 shows the effects wheel 1 in a position in which it is moved in the first direction "x". As can be seen in the optical axis 80, the lines present on the surface of the effects wheel 1 are situated inside said optical axis 80, in a substantially horizontal direction. As the effects wheel 1 turns about its central axis 10, the optical effect obtained according to the example illustrated in FIG. 4 is a lighting effect comparable to "waves".

Figure 5:
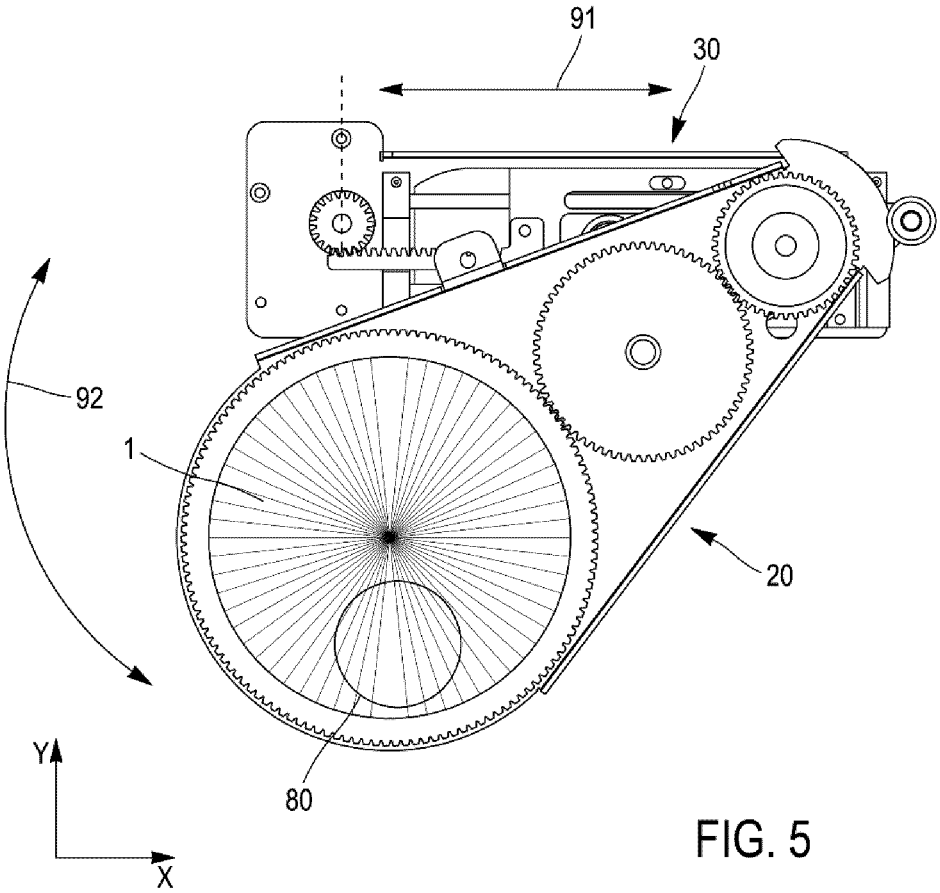
FIG. 5 depicts the effects wheel for the lighting device according to FIG. 3, said effects wheel being moved into a second position "y" relative to the position as shown in FIG. 3.

FIG. 5 depicts an example according to which the effects wheel 1 is moved, relative to the position as illustrated in FIG. 3, in the direction "y". As can be seen in the optical axis 80, the lines present on the surface of the effects wheel 1 are depicted in a substantially vertical direction. As the effects wheel 1 turns about its central axis 10, the optical effect obtained according to the example illustrated in FIG. 5 is a lighting effect comparable to "flames".

With reference to FIGS. 3, 4 and 5, it is evident that the effects wheel 1 makes it possible to obtain visual effects from an intermediate position, such as an intermediate position, for example, between the positions illustrated in FIG. 3 and FIG. 5 or, alternatively, an intermediate position between the positions illustrated in FIG. 4 and FIG. 5.

It should be noted that the effects wheel 1 can move relatively easily and simply, with the aid of the movements of the sliding element 30 and pivoting element 20, resulting in sequences of various visual effects without the user being compelled to modify said effects wheel 1.

According to an alternative embodiment of the invention (not shown in the figures), the effects wheel 1 can be covered with a decoration made up of circular lines, the various circles of which can be concentric about the central axis 10 of said effects wheel 1. A decoration of this type makes it possible to obtain technical effects when the effects wheel 1 is positioned according to the examples illustrated in FIGS. 3, 4 and 5 or in intermediate positions.

It should be noted that above and beyond the types of decoration of the effects wheel 1, which are shown in the figures and mentioned above, said effects wheel 1 can also be adorned with one or more colours, thus increasing the quantity of visual effects which can be obtained.

According to an alternative embodiment of the invention (not shown in the figures), the effects wheel 1 can be covered with a limited quantity of various drawings, with each drawing being of a size substantially equal to the size of the optical axis 80 of the device on which said effects wheel 1 is used. By virtue of the sliding element 30 and the pivoting element 20, each of the drawings covering the surface of the effects wheel 1 can be positioned inside the optical axis 80 in which said effects wheel 1, in this use, does not necessarily pivot about its central axis 10. The option described above, using the sliding element 30 and the pivoting element 20, makes it possible to obtain, with the aid of a single effects wheel 1, visual effects of radically different types.

The invention claimed is:

1. A lighting device for creating a light beam comprising a light source and an optical element positioned along an optical axis between said light source and an outlet for said light beam wherein said optical element comprises an at least partially transparent or translucent effects wheel, said effects wheel being movable between a first active position in which the effects wheel is positioned along said optical axis and a second inactive position in which the effects wheel is positioned outside said optical axis, and actuation means suitable for moving the effects wheel in a back-and-forth movement between its first active position and its second inactive position, said actuation means are suitable for causing the effects wheel to turn about an axis of rotation of said effects wheel and for moving the effects wheel in a back-and-forth movement between its first active position and its second inactive position in a first direction and a second direction which is substantially perpendicular to this first direction relative to the optical axis of the lighting device to make it possible to position various parts of the surface of the effects wheel along the optical axis of the lighting device, characterised in that the actuation means comprise a sliding element fixed on a base of said lighting device and are suitable for causing the effects wheel to perform a back-and-forth movement relative to the optical axis of the lighting device and a pivoting element fixed to said sliding element with the aid of a pivot axis and suitable for causing the effects wheel to pivot about said pivot axis relative to said sliding element, wherein the effects wheel is fixed to the pivoting element, wherein the actuation means comprise a holding element suitable for holding the circumference of the effects wheel and for allowing the effects wheel to rotate relative to said holding element and driving means suitable for gripping the circumference of the effects wheel and for causing the effects wheel to turn relative to the holding element.

2. The lighting device according to claim 1, wherein the circumference of the effects wheel is provided with teeth and wherein the driving means comprise at least one toothed wheel suitable for transmitting a rotation to said effects wheel (1).

3. The lighting device according to claim 1, wherein the surface of the effects wheel is covered with a coating substantially in the form of spokes which emanate from the centre of the effects wheel.

4. The lighting device according to claim 1, wherein the surface of the effects wheel is covered with a coating substantially in the form of concentric circles around the centre of the effects wheel.

5. The lighting device according to claim 1, wherein the device comprises a base, a projector connected to the base with the aid of a yoke to allow said projector to pivot relative to the base, wherein said light source and said optical element are positioned in said projector.

6. An effects wheel suitable for a lighting device according to claim 1, wherein the effects wheel is at least partially transparent or translucent and movable between a first active position, in which the effects wheel is positioned along an optical axis of said lighting device, and a second inactive position, in which the effects wheel is positioned outside said optical axis and actuation means suitable for moving the effects wheel in a back-and-forth movement between its first active position and its second inactive position, said actuation means are suitable for causing the effects wheel to turn about the axis of rotation of said effects wheel and for moving the effects wheel in a back-and-forth movement between its first active position and its second inactive position in a first direction and a second direction substantially perpendicular to the first direction relative to the optical axis of the lighting device to make it possible to position various parts of the surface of the effects wheel in the optical axis of the lighting device, characterised in that the actuation means comprise a sliding element fixed on a base of said lighting device and are suitable for causing the effects wheel to move back-and-forth relative to the optical axis of the lighting device and a pivoting element fixed to said sliding element with the aid of a pivot axis and suitable for causing the effects wheel to pivot about said pivot axis relative to said sliding element, wherein the effects wheel is fixed to the pivoting element.

* * * * *